United States Patent [19]

Hibino et al.

[11] Patent Number: 4,753,209

[45] Date of Patent: Jun. 28, 1988

[54] AIR-FUEL RATIO CONTROL SYSTEM FOR INTERNAL COMBUSTION ENGINES CAPABLE OF CONTROLLING AIR-FUEL RATIO IN ACCORDANCE WITH DEGREE OF WARMING-UP OF THE ENGINES

[75] Inventors: Yoshitaka Hibino; Takeshi Fukuzawa, both of Wako, Japan

[73] Assignee: Honda Giken Kogyo Kabushiki Kaisha, Japan

[21] Appl. No.: 81,475

[22] Filed: Aug. 3, 1987

[30] Foreign Application Priority Data

Dec. 27, 1986 [JP] Japan ..... 61-310658

[51] Int. Cl.[4] ..... F02M 51/00

[52] U.S. Cl. ..... 123/491; 123/440; 123/589

[58] Field of Search ..... 123/440, 489, 589, 491, 123/179 G, 179 L

[56] References Cited

U.S. PATENT DOCUMENTS

| | | | |
|---|---|---|---|
| 4,321,902 | 3/1982 | Stoltman | 123/491 |
| 4,348,996 | 9/1982 | Morozumi | 123/491 |
| 4,528,961 | 7/1985 | Katoh | 123/440 |
| 4,619,237 | 10/1986 | Auslander | 123/440 |

FOREIGN PATENT DOCUMENTS

| | | | |
|---|---|---|---|
| 58-20950 | 7/1981 | Japan | 123/491 |
| 57-7297 | 2/1982 | Japan | 123/491 |

*Primary Examiner*—Ronald B. Cox

*Attorney, Agent, or Firm*—Charles S. McGuire

[57] ABSTRACT

While an exhaust gas sensor having an output characteristic linear with respect to the concentration of a specific component in exhaust gases from an internal combustion engine, the opening of an automatic choke valve is controlled in response to the degree of warming-up of the engine. From the time of activation of the exhaust gas sensor to the time of completion of warming-up of the engine, the automatic choke valve and an air-fuel ratio control valve arranged in an air passage bypassing a throttle valve in an intake passage of the engine, are driven so as to achieve a desired air-fuel ratio, respectively, when the difference between the desired air-fuel ratio and actual one is larger than a predetermined value, and when the difference is smaller than the predetermined value. After completion of warming-up of the engine, the air-fuel ratio control valve is driven in response to operating conditions of the engine so as to achieve the desired air-fuel ratio.

9 Claims, 4 Drawing Sheets

AIR-FUEL RATIO CONTROL SYSTEM FOR INTERNAL COMBUSTION ENGINES CAPABLE OF CONTROLLING AIR-FUEL RATIO IN ACCORDANCE WITH DEGREE OF WARMING-UP OF THE ENGINES

BACKGROUND OF THE INVENTION

This invention relates to an air-fuel ratio control system for internal combustion engines, which is capable of appropriately controlling the air-fuel ratio in accordance with the degree of warming-up of the engines.

It has been generally carried out to set the air-fuel ratio of a mixture supplied to an internal combustion engine to such a small value as can secure stable operation of the engine during cold starting of the engine and/or during warming-up of the engine immediately following the cold starting of the engine, and on the other hand, to set the air-fuel ratio to such large values as correspond to operating conditions of the engine after the warming-up of the engine has been completed, since the operation of the engine becomes stable after completion of the warming-up. In order to satisfy required operating characteristics of an internal combustion engine such as driveability, fuel consumption and exhaust emission characteristics at the same time, it is prerequisite that the air-fuel ratio should be accurately controlled in accordance with warming-up conditions of the engine. On the other hand, exhaust gas sensors for sensing the concentration of a specific component in exhaust gases from internal combustion engines, as represented by an $O_2$ sensor, are generally used in feedback control of the air-fuel ratio. Such exhaust gas sensors need to be activated before they normally operate, that is, the temperature of the sensors per se has to be elevated up to a prescribed activating temperature. Therefore, conventionally, when the engine is started while it is in a cold state, the air-fuel ratio feedback control cannot be effected due to the exhaust gas sensor being inactive.

There have been proposed air-fuel ratio control systems which are intended to appropriately control the air-fuel ratio by taking into account the aforementioned difference in required air-fuel ratio between during cold starting of an internal conbustion engine and after completion of the warming-up of the engine, e.g. by Japanese Patent Publication (Kokoku) No. 57-7297 (hereinafter called "Conventional System 1") and Japanese Provisional Patent Publication (Kokai) No. 58-20950 (hereinafter called "Conventional System 2").

According to Conventional System 1, the air-fuel ratio is controlled by an automatic choke valve when the ambient temperature of an internal combustion engine is below a first predetermined value, by an air-fuel ratio control valve which regulates an amount of air introduced into an air bleed of a carburetor, in response to the ambient temperature when the ambient temperature is above the first predetermined value and below a second predetermined value, and by the air-fuel ratio control valve in response to the output from an exhaust gas sensor when the ambient temperature is above the second predetermined value, respectively. That is, according to Conventional System 1, when the engine ambient temperature is in an intermediate range between the first predetermined value and the second predetermined value, the air-fuel ratio is not controlled in feedback mode responsive to the output from the exhaust gas sensor but it is controlled in response to the engine ambient temperature by the air-fuel ratio control valve, which, however, results in the air-fuel ratio not being accurately controlled to a desired value. Further, when the engine ambient temperature is in the intermediate range, the air-fuel ratio has to be controlled to a relatively small or rich value required by the engine so as to prevent stalling of the engine which is being warmed up, which is disadvantageous in respect of fuel economy.

On the other hand, according to Conventional System 2, an $O_2$ sensor which has an output characteristic linear with respect to the concentration of oxygen in exhaust gases is used as the exhaust gas sensor to sensor the actual air-fuel ratio, and the air-fuel ratio is controlled to a desired value in feedback manner such that an air-fuel ratio control valve which regulates the fuel supply amount is controlled in response to the result of comparison between the actual air fuel ratio and the desired one. However, if the air-fuel ratio control valve is controlled by means of digital computation, the resolution power of control of the valve is set as a function of a quotient resulting from equal division of the controlling range of the air-fuel ratio by a given number. Therefore, as the controlling range of the air-fuel ratio becomes larger, the resolution power becomes degraded. If Conventional System 2 is applied both during and after warming-up of the engine, the controlling range of the air-fuel ratio is larger as compared with the case where it is applied only after warming-up of the engine, and accordingly the resolution power, i.e. the control accuracy becomes degraded, thus making it difficult to control the air-fuel ratio to a desired value. After warming-up of the engine in particular, although the engine operation becomes stable so that the variation width of the air-fuel ratio becomes small, the air-fuel ratio has to be controlled in a fine manner so as to secure required driveability and exhaust emission characteristics of the engine, which, however, cannot be achieved owing to the above-mentioned degraded resolution power.

SUMMARY OF THE INVENTION

It is the object of the invention to provide an air-fuel ratio control system for an internal combustion engine, which is capable of controlling the air-fuel ratio to a desired one in an accurate manner to thereby achieve required driveability, fuel consumption and exhaust emission characteristics of the engine, both during and after warming-up of the engine.

In order to achieve the object, the present invention provides an air-fuel ratio control system for an internal combustion engine, the system having an automatic choke valve arranged in an intake passage of the engine, an exhaust gas sensor arranged in an exhaust passage of the engine and having an output characteristic linear with respect to the concentration of a specific component in exhaust gases from the engine, an air passage bypassing a throttle valve in the intake passage, an air-fuel ratio control valve arranged in the air passage and disposed to be driven in response to an output from the exhaust gas sensor for controlling the air-fuel ratio of a mixture supplied to the engine, and temperature sensing means for sensing the degree of warming-up of the engine.

The air-fuel ratio control system according to the invention is characterized by the combination comprising: determining means for determining whether the exhaust gas has been activated; means for controlling the opening of the automatic choke valve in response to the degree of warming-up of the engine sensed by the temperature sensing means while the determining means determines that the exhaust gas sensor is inactive; means for determining the difference between a desired value of the air-fuel ratio and an actual value thereof sensed by the exhaust gas sensor, and for driving the automatic choke valve when the determined difference is larger than a predetermined value, and the air-fuel ratio control valve when the determined difference is smaller than the predetermined value, respectively, from the time the determining means determines for the first time that the exhaust gas sensor has become activated to the time the temperature sensing means detects completion of warming-up of the engine; and means for driving the air-fuel ratio control valve in response to operating conditions of the engine so as to achieve a desired value of the air-fuel ratio, after the temperature sensing means detects completion of warming-up of the engine.

Preferably, the air-fuel ratio control system according to the invention includes setting means for setting a desired value of the air-fuel ratio in dependence on the degree of warming-up of the engine sensed by the temperature sensing means, from the time the determining means determines for the first time that the exhaust gas sensor has become activated to the time the temperature sensing means detects completion of warming-up of the engine.

More preferably, the above setting means sets the desired value of the air-fuel ratio in dependence on engine coolant temperature and intake air temperature.

Preferably, the above-mentioned means for controlling the opening of the automatic choke valve controls the opening of the automatic choke valve in dependence on intake air temperature and atmospheric pressure, while the determining means determines that the exhaust gas sensor is inactive.

Also preferably, the opening of the air-fuel ratio control valve is held at one of maximum and minimum values thereof and the opening of the automatic choke valve is varied so that the actual value of the air-fuel ratio becomes equal to the desired value thereof when the difference between the desired value of the air-fuel ratio and the actual value thereof is larger than the predetermined value, from the time the determining means determines for the first time that the exhaust gas sensor has become activated to the time the temperature sensing means detects completion of warming-up of the engine.

Preferably, the opening of the air-fuel ratio control valve is set to values corresponding to the difference between the desired value of the air-fuel ratio and the actual value thereof and the opening of the automatic choke valve is held at an immediately preceding value thereof when the difference between the desired value of the air-fuel ratio and the actual value thereof is smaller than the predetermined value, from the time the determining means determines for the first time that the exhaust gas sensor has become activated to the time the temperature sensing means detects completion of warming-up of the engine.

The opening of the air-fuel ratio control valve is set to values corresponding to the difference between the desired value of the air-fuel ratio and the actual value thereof and the opening of the automatic choke valve is held at a maximum value thereof after the temperature sensing means detects completion of warming-up of the engine.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
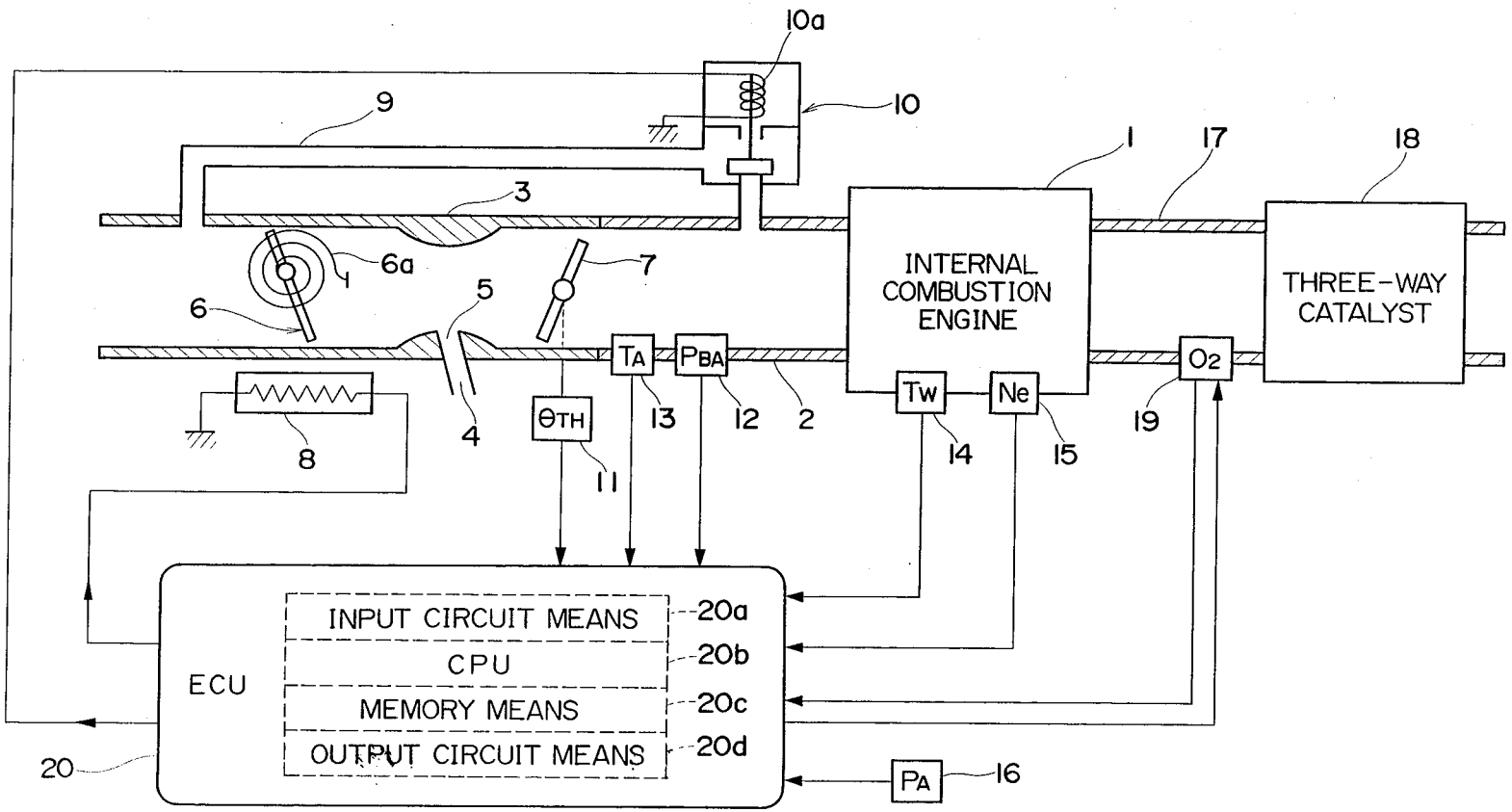
FIG. 1 is a block diagram illustrating the whole arrangement of an air-fuel ratio control system for an internal combustion engine, according to an embodiment of the invention.

Referring first to FIG. 1, there is shown the whole arrangement of an air-fuel ratio control system for an internal combustion engine according to the invention. Connected to the engine 1 which may be a four-cylinder type is an intake pipe 2 which is provided therein with a venturi 3 forming part of a carburetor. One end of a fuel passage 4 opens, as a nozzle 5, into the interior of the intake pipe 2 at the venturi 3, and the other end of the fuel passage 4 leads to a float chamber, not shown, of the carburetor.

An automatic choke valve 6 is arranged in the intake pipe 2 upstream of the venturi 3, and a throttle valve 7 downstream of the venturi 3, respectively. The automatic choke valve 6 comprises a bimetal 6*a*, and a heater 8, and is disposed to have its opening decreased as the temperature of the bimetal 6*a* becomes lower. The heater 8 is electrically connected to an electronic control unit (hereinafter called "the ECU") 20 to have its energizing duty ratio D controlled by the latter so as to have its heat generation amount controlled accordingly, whereby the temperature of the bimetal 6 is controlled to thereby control the opening degree of the choke valve 6 as well as the opening and closing speeds thereof. The heater 8 is preferably formed by a well-known PTC heater, which, when its temperature rises above a predetermined value, suddenly increases in electric resistance so that the amount of current flowing therethrougn suddenly decreases and accordingly the heat generation amount is restricted below a predetermined value.

In FIG. 1, reference numeral 9 designates a secondary air supply passage, which communicates at one end thereof with the interior of the intake pipe 2 upstream of the choke valve 6 and at the other end with the interior of the intake pipe 2 downstream of the throttle valve 7, thus bypassiong the throttle valve 7. Arranged across the secondary air supply passage 9 is an electromagnetic valve 10 which is a normally closed and two-position type on-off valve and has a solenoid 10*a* disposed to be energized with a duty ratio set by the ECU 20 so that the valve opening is controlled to thereby control the amount of secondary air supplied to the engine 1 through the secondary air supply passage 9.

A throttle valve opening (θth) sensor 11 is connected to the throttle valve 7, for supplying an electric signal indicative of the sensed opening of the valve 7 to the ECU 20. An absolure pressure (PBA) sensor 12 and an intake air temperature (TA) sensor as a temperature sensing means are provided for sensing absolute pressure and intake air temperature in the intake pipe 2 downstream of the throttle valve 7, respectively, and supplying electric signals indicative of the sensed PBA and TA values to the ECU 20.

An engine coolant temperature (TW) sensor 14 as another temperature sensing means is mounted on the cylinder block of the engine 1. To be specific, the sensor 14 is embedded in the peripheral wall of a cylinder, not shown, of the engine 1 filled with engine coolant, for supplying an electric signal indicative of the sensed coolant temperature value to the ECU 20. An engine rotational speed (Ne) sensor 15 is arranged in facing relation to a camshaft or a crankshaft of the engine 1, neither of which is shown, and adapted to generate a pulse corresponding to one of predetermined crank angle positions each time the crankshaft rotates through 180 degrees, the pulse being supplied to the ECU 20 as a TC signal pulse.

An atmospheric pressure (PA) sensor 16 is electrically connected to the ECU 20 for supplying an electric signal indicative of the sensed atmospheric pressure value thereto.

A three-way catalyst 18 is arranged within an exhaust pipe 7 of the engine 1 for purifying HC, CO and NOx components in exhaust gases emitted from the engine 1. An $O_2$ sensor 19 as an exhaust gas sensor is inserted into the exhaust pipe 17 for sensing the concentration of oxygen in the exhaust gases. The $O_2$ sensor 19 employed by the present invention has such an output characteristic that the output voltage from the sensor 19 varies linearly with respect to the oxygen concentration in the exhaust gases, in other words, an output characteristic which is linear with respect to the air-fuel ratio of a mixture supplied to the engine 1. The $O_2$ sensor 19 generates an electric signal indicative of the sensed air-fuel ratio and supplies same to the ECU 20. The $O_2$ sensor 19 has a built-in heater, not shown, which generates heat when supplied with current from the ECU 20 to heat the sensor body so that the sensor becomes activated within a short period of time, e.g. after the lapse of about 10 seconds since an ignition switch, not shown, of the engine 1 is turned on even at cold starting of the engine 1.

The ECU 20 is mainly composed of input circuit means 20*a* having functions, e.g. of shaping the waveforms of input signals from part of the above-mentioned various sensors, shifting the levels of output voltages from part of the sensors into a predetermined level, converting analog output signals from part of the sensors into respective digital signals, a central processing unit (hereinafter called "the CPU") 20*b*, memory means 20*c* storing control programs executed within the CPU 20*b*, and for storing results of various calculations executed within the CPU 20*b*, and output circuit means 20*d* having functions, e.g. of supplying driving signals to the heater 8 and the electromagnetic valve 10, etc. Further, a timer, not shown, is provided within the ECU 20 as determining means for determining the state of activation of the $O_2$ sensor 19.

Figure 2:
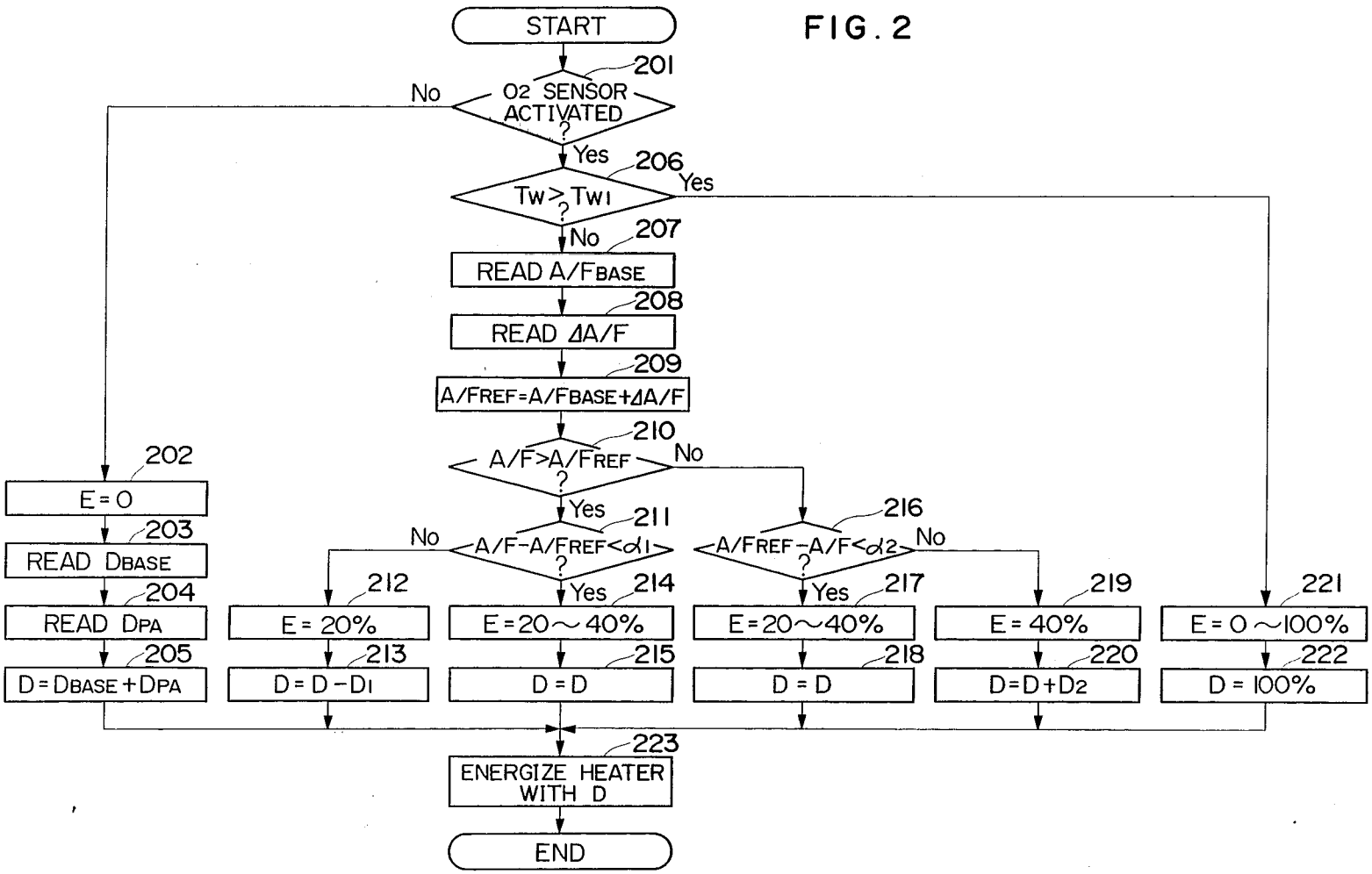
FIG. 2 is a flowchart of a program for carrying out the air-fuel ratio control according to the invention.

FIG. 2 is a flowchart of a control program for carrying out the air-fuel ratio control by means of the air-fuel ratio control system of the invention shown in FIG. 1, The present program is executed upon generation of each TDC signal pulse.

Figure 3:
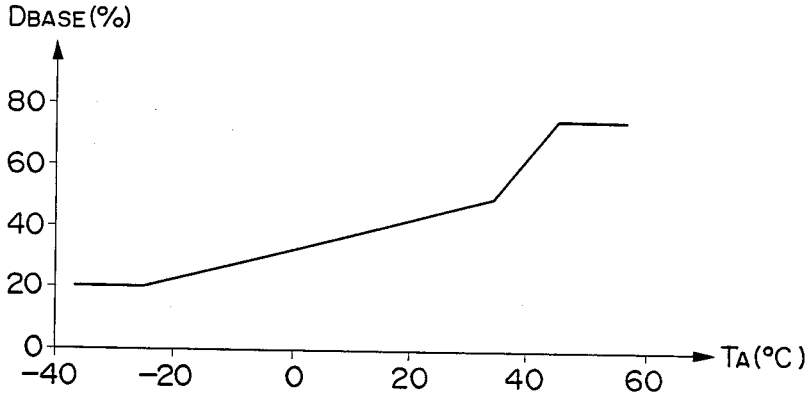
FIG. 3 is a graph showing a table of the relationship between a basic value of duty ratio for a heater of an automatic choke valve in FIG. 1 and intake air temperature.
Figure 4:
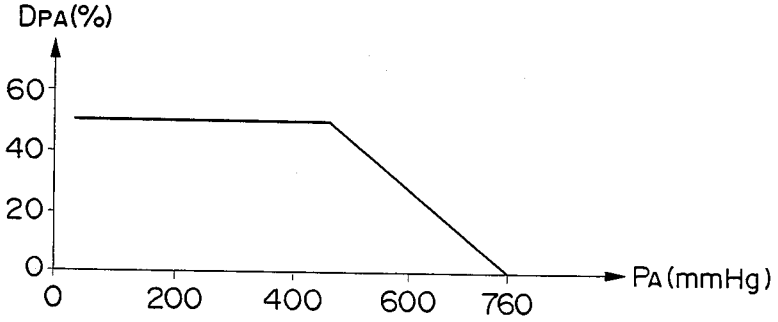
FIG. 4 is a graph showing a table of the relationship between an atmospheric pressure-dependent correction value for the duty ratio of the heater and atmospheric pressure.

First at a step 201, it is determined whether or not the $O_2$ sensor 19 has been activated. The determination is made by determining whether or not a predetermined period of time (e.g. 10 seconds) has elapsed from the time the ignition switch has been turned on. If the answer to the question of the step 201 is negative, that is, if the $O_2$ sensor 19 is inactive, a rich air-fuel ratio is then required, and the program proceeds to a step 202 wherein the valve opening or energizing pulse duty ratio E of the electromagnetic valve 10 is held at 0 to make the secondary air supply amount zero. Then, the program proceeds to a step 203 to determine a basic value DBASE of the energizing duty rato of the heater 8 from the intake air temperature TA sensed by the intake air temperature sensor 13. FIG. 3 shows, by way of example, a table of the relationship between intake air temperature TA and the duty ratio basic value $D_{BASE}$, according to which the basic value $D_{BASE}$ is set to smaller values as the intake air temperature becomes lower, that is, as the degree of warming-up of the engine 1 is lower. Then, a step 204 is executed to determine an atmospheric pressure-dependent correction value $D_{PA}$ from the atmospheric pressure PA sensed by the atmospheric pressure sensor 16. FIG. 4 shows, by way of example, a table of the relationship between atmospheric pressure PA and the atmospheric pressure-dependent correction value $D_{PA}$, according to which the correction value $D_{PA}$ is set to zero and 50%, respectively, when the atmospheric pressure PA is 760 mmHg or higher and when it is 450 mmHg or lower, and is determined by means of an interpolation method when the atmospheric pressure PA is between 450 mmHg and 760 mmHg so as to decrease with increase in the atmospheric pressure PA. This atmospheric pressure-dependent correction of the duty ratio D of the heater 8 is effective for preventing the mixture from becoming overrich due to decrease in the air density due to a drop in the atmospheric pressure PA. Then, the program proceeds to a step 205 wherein the duty ratio D of the heater 8 is calculated by the use of the following equation (1) using the basic value $D_{BASE}$ and the atmospheric pressure-dependent correction value $D_{PA}$ read at the steps 204 and 204, respectively:

$$D = D_{BASE} + D_{PA} \quad (1)$$

Then the program proceeds to a step 223 to energize the heater 8 with the duty ratio D thus calculated, followed by termination of the program. As is learned from the above, when the $O_2$ sensor 19 is determined to be inactive, the electromagnetic valve 10 is kept closed to make the seconary air supply amount zero, while the duty ratio D of the heater 8 is set to a value corresponding to intake air temperature TA and atmospheric pressure PA, whereby the engine 1 is supplied with a mixture having an appropriate small or rich air-fuel ratio set in accordance with the degree of warming-up of the engine as well as atmospheric pressure PA.

Figure 5:
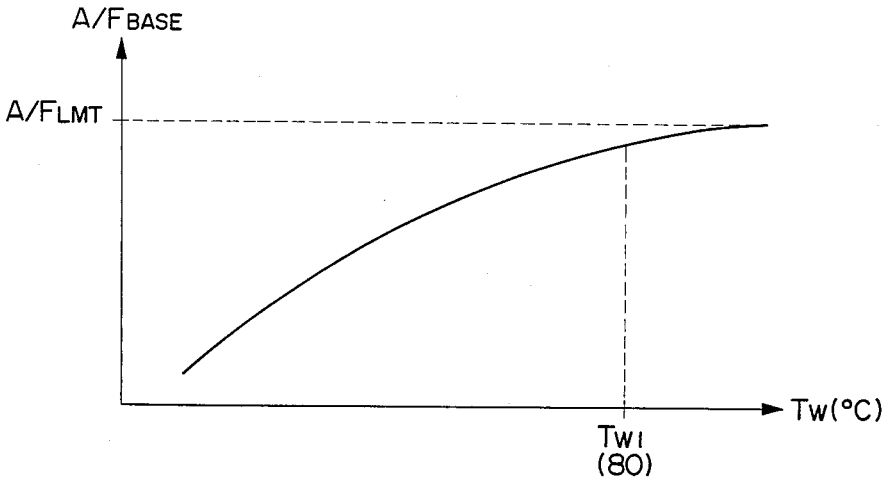
FIG. 5 is a graph showing a table of the relationship between a basic value of the air-fuel ratio and engine coolant temperature.

If the answer to the question of the step 201 is affirmative or Yes, that is, if the $O_2$ sensor 19 has become activated, the program proceeds to a step 206 wherein it is determined whether or not the engine coolant temperature TW is higher than a predetermined value TW1 (e.g. 80° C.). This determination is intended to determine whether or not the engine 1 has become fully warmed up. If the answer is negative or No, that is, if TW=TW1 stands and accordingly it is determined that the engine 1 has not been warmed up as yet, the program proceeds to a step 207 wherein a basic value $A/F_{BASE}$ of the desired air-fuel ratio is determined from the engine coolant temperature TW sensed by the engine coolant temperature sensor 14. FIG. 5 shows, by way of example, a table of the relationship between engine coolant temperature TW and the basic value $A/F_{BASE}$, according to which the basic value $A/F_{BASE}$ is set to smaller values as the engine coolant temperature becomes lower, and it is set to values along a curve converging to a final desired air-fuel ratio $A/F_{LMT}$ (e.g. 14.7) after completion of warming-up of the engine when the engine coolant temperature TW exceeds the aforementioned predetermined value TW1.

Figure 6:
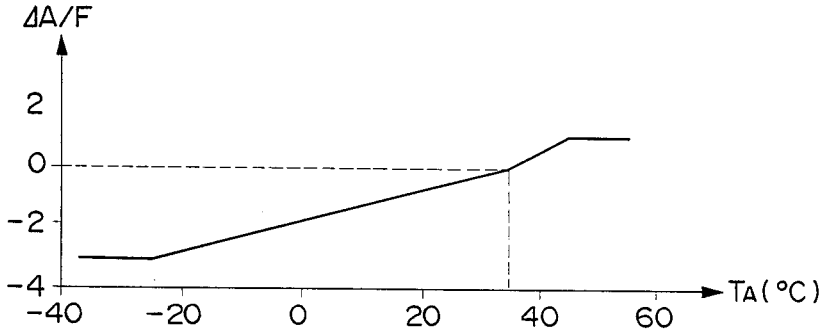
FIG. 6 is a graph showing a table of the relationship between a correction value for the air-fuel ratio and intake air temperature.

The program then proceeds to a step 208 wherein a correction value $\Delta A/F$ for the desired air-fuel ratio is determined from the intake air temperature TA. FIG. 6 shows, by way of example, a table of the relationship between the correction value $\Delta A/F$ and intake air temperature TA. The correction value $\Delta A/F$ is set to 0, −3.0, and +1.0, respectively, when the intake air temperature TA is equal to +35° C., below −25° C., and above +45° C., and it is determined by means of an interpolation method so as to increase with rise in the intake air temperature when the intake air temperature TA lies between −25° C. and +35° C. and between +35° C. and +45° C.

The program then proceeds to a step 209 to calculate the desired air-fuel ratio $A/F_{REF}$ by the use of the following equation (2) using the basic value $A/F_{BASE}$ and the correction value $\Delta A/F$ read at the steps 207 and 208, respectively:

$$A/F_{REF}=A/F_{BASE}+\Delta A/F \quad (2)$$

Thus, the desired air-fuel ratio $A/F_{REF}$ is set in response to the engine coolant temperature TW and the intake air temperature TA such that it becomes smaller as the values of these temperatures are lower, that is, as the degree of warming-up of the engine is lower. Since the desired air-fuel ratio $A/F_{REF}$ is set in dependence on two different temperature parameters of engine coolant temperature TW and intake air temperature TA, which are sensed at different locations of the engine 1 and both represent the warming-up condition of the engine 1, the desired air-fuel ratio can be set to a more appropriate value as compared with setting of the desired air-fuel ratio in dependence on a single temperature parameter, e.g. engine coolant temperature TW.

The basic value $A/F_{BASE}$ of the desired air-fuel ratio and the correction value $\Delta A/F$ may be set in dependence on the intake air temperature TA and the engine coolant temperature TW, respectively, i.e. in a manner reverse to the above described embodiment.

Then, the program proceeds to a step 210 wherein it is determined whether or not the actual air-fuel ratio A/F sensed by the $O_2$ sensor 19 is larger than the desired air-fuel ratio $A/F_{REF}$ set at the step 209. If the answer is affirmative or Yes, it is determined at a step 211 whether or not the difference between the actual and desired air-fuel ratios is smaller than a predetermined value $\alpha 1$ (e.g. 1.0–2.0). If the answer is negative or No, that is, if the actual air-fuel ratio A/F is larger than the desired air-fuel ratio $A/F_{REF}$, and at the same time the difference between the two air-fuel ratios is relatively large, it is then necessary to largely reduce or enrich the actual air-fuel ratio. Therefore, a step 212 is called for wherein the duty ratio E of the electromagnetic valve 10 is held at the minimum value applied during warming-up of the engine 1, e.g. 20%, and the duty ratio D of the heater 8 is set to a value smaller than an immediately preceding value set at the time of generation of an immediately preceding TDC signal pulse, by a predetermined value D1 (e.g. 0.01–1.0%), followed by execution of the aforementioned step 223 and termination of the program.

If the answer to the question of the step 211 is affirmative or Yes, that is, if the actual air-fuel ratio A/F is larger than the desired one $A/F_{REF}$ and at the same time the difference between the two air-fuel ratios is relatively small, the program proceeds to a step 214 wherein the duty ratio E of the electromagnetic valve 10 is set to a value dependent upon the air-fuel ratio difference, within a range from 20 to 40% in such a manner that it is set to smaller values as the air-fuel ratio difference is larger. Then at a step 215 the duty ratio D of the heater 8 is set to the same value set at the time of generation of an immediately preceding TDC signal pulse, followed by execution of the step 223 and termination of the program. Thus, the actual air-fuel ratio is controlled to the desired one with accuracy.

If the answer to the question of the step 210 is negative or No, that is, if the actual air-fuel ratio is smaller than the desired air-fuel ratio $A/F_{REF}$, the program proceeds to a step 216 wherein it is determined whether or not the air-fuel ratio difference is smaller than a predetermined value $\alpha 2$ (e.g. 1.0–2.0). If the answer is affirmative or Yes, that is, if the actual air-fuel ratio A/F is smaller than the desired one $A/F_{REF}$ and at the same time the air-fuel ratio difference is relatively small, steps 217 and 218 are executed to control the duty ratios E and D, respectively, just in the same manner as the aforedescribed steps 214 and 215.

If the answer to the question of the step 216 is negative or No, that is, if the actual air-fuel ratio A/F is smaller than the desired one $A/F_{REF}$ and at the same time the air-fuel ratio difference is relatively large, it is then necessary to largely increase or lean the actual air-fuel ratio A/F. Therefore, a step 219 is called for wherein the duty ratio E of the electromagnetic valve 10 is held at the maximum value applied during warming-up of the engine, e.g. 40% to thereby supply the maximum quantity of secondary air to the engine 1. Then at a step 220 the duty ratio D of the heater 8 is set to a value larger than an immediately preceding value set at the time of generation of an immediately preceding TDC signal pulse, by a predetermined value D2 (e.g. 0.01–1.0%), followed by execution of the aforementioned step 223 and termination of the program.

As described above, according to the invention, from the time of activation of the $O_2$ sensor 19 to the time of completion of warming-up of the engine 1 the desired air-fuel ratio $A/F_{REF}$ is set to appropriate values in dependence on two parameters representative of the degree of warming-up of the engine 1, e.g. engine coolant temperature TW and intake air temperature TA. Further, depending upon the magnitude of the difference between the actual air-fuel ratio A/F and the desired one $A/F_{REF}$, the air-fuel ratio is controlled in different manners. That is, when the air-fuel ratio difference is relatively large, the valve opening of the choke valve 6, which is adapted to change the actual air-fuel ratio A/F at a large rate, is feedback-controlled, whereas when the air-fuel ratio difference is relatively small, the duty ratio E of the electromagnetic valve 10, which is adapted to change the actual air-fuel ratio A/F in a fine manner, is feedback-controlled. By virtue of this controlling manner, the air-fuel ratio range that is to be controlled by the electromagnetic valve 10 can be made moderately narrow, making it possible to control the actual air-fuel ratio A/F to the desired one $A/F_{REF}$ with high accuracy as well as with high responsiveness, with the aid of the choke valve 6.

If the answer to the question of the step 206 is affirmative or Yes, that is, TW TW1 stands so that it is judged that the engine 1 has been warmed up, the program proceeds to a step 221 wherein the duty ratio E of the electromagnetic valve 10 is controlled to values within a range from 0 to 100% depending upon the difference between the actual air-fuel ratio A/F and the desired one $A/F_{REF}$. Also on this occasion the desired air-fuel ratio $A/F_{REF}$ is set in dependence on the engine coolant temperature TW and the intake air temperature TA in accordance with the tables of FIGS. 5 and 6, as in the control during warming-up of the engine 1. The program then proceeds to a step 222 wherein the duty ratio D of the heater 8 is held at 100%, followed by execution of the step 223 and termination of the program. In this way, after completion of warming-up of the engine 1, the choke valve 6 is kept fully open, i.e. kept inoperative, and at the same time air-fuel feedback control is carried out based upon the output from the $O_2$ sensor 19, whereby the actual air-fuel ratio A/F is controlled to the desired air-fuel ratio $A/F_{REF}$ with high accuracy.

Since the heater 8 is formed of a PTC heater, even if the duty ratio D is held at 100%, the heat.generation amount is so small that the choke valve 6 is kept fully open without hindrance.

The air-fuel ratio control system according to the invention, which performs the air-fuel ratio control in the above described manner, provides excellent results as follows:

(i) Since the valve opening of the automatic choke valve 6 is controlled to a value corresponding to the degree of warming-up of the engine, that is, to the output from the temperature sensing means 13 while the $O_2$ sensor 19 is inactive, an appropriate air-fuel ratio can be achieved;

(ii) Since from the time of activation of the $O_2$ sensor 19 to the time of completion of warming-up of the engine the desired air-fuel ratio is set in dependence on the degree of warming-up of the engine as well as on a plurality of temperature parameters (e.g. TW and TA), the desired air-fuel ratio can be set to an appropriate value.

(iii) By virtue of the use of the exhaust gas sensor which has an output characteristic linear with respect to the actual air-fuel ratio, the actual air-fuel ratio can be sensed with accuracy so that the air-fuel ratio can be accurately controlled to the desired one;

(iv) Since from the time of activation of the $O_2$ sensor 19 to the time of completion of warming-up of the engine the automatic choke valve 6 is driven when the difference between the actual air-fuel ratio and the desired air-fuel ratio is large, whereby the actual air-fuel ratio is largely changed to promptly bring the actual air-fuel ratio to the desired one, whereas the air-fuel ratio control valve 10 is driven when the air-fuel ratio difference is small, whereby the actual air-fuel ratio is finely adjused to the desired one, the air-fuel ratio range that is to be controlled by the air-fuel ratio control valve can be made moderately narrow, thereby securing required control accuracy;

(v) Since after completion of warming-up of the engine the air-fuel ratio control valve is driven so that the actual air-fuel ratio is brought to the desired one, the actual air-fuel ratio can be controlled with accuracy both during warming-up of the engine and after completion of the warming-up in cooperation with the results (i)–(iv), thereby enabling to satisfy all requirements in respect of driveability, fuel consumption and exhaust emission characteristics of the engine.

What is claimed is:

1. In an air-fuel ratio control system for an internal combustion engine, said system having an automatic choke valve arranged in an intake passage of said engine, an exhaust gas sensor arranged in an exhaust passage of said engine and having an output characteristic linear with respect to the concentration of a specific component in exhaust gases from said engine, an air passage bypassing a throttle valve in said intake passage, an air-fuel ratio control valve arranged in said air passage and disposed to be driven in response to an output from said exhaust gas sensor for controlling the air-fuel ratio of a mixture supplied to said engine, and temperature sensing means for sensing the degree of warming-up of said engine, the combination comprising: determining means for determining whether said exhaust gas has been activated; means for controlling the opening of said automatic choke valve in response to the degree of warming-up of said engine sensed by said temperature sensing means while said determining means determines that said exhaust gas sensor is inactive; means for determining the difference between a desired value of the air-fuel ratio and an actual value thereof sensed by said exhaust gas sensor, and for driving said automatic choke valve when the determined difference is larger than a predetermined value, and said air-fuel ratio control valve when the determined difference is smaller than said predetermined value, respectively, from the time said determining means determines for the first time that said exhaust gas sensor has become activated to the time said temperature sensing means detects completion of warming-up of said engine; and means for driving said air-fuel ratio control valve in response to operating conditions of said engine so as to achieve a desired value of the air-fuel ratio, after said temperature sensing means detects completion of warming-up of said engine.

2. An air-fuel ratio control system as claimed in claim 1, including setting means for setting a desired value of the air-fuel ratio in dependence on the degree of warming-up of said engine sensed by said temperature sensing means, from the time said determining means determines for the first time that said exhaust gas sensor has become activated to the time said temperature sensing means detects completion of warming-up of said engine.

3. An air-fuel ratio control system as claimed in claim 2, wherein said setting means sets said desired value of the air-fuel ratio in dependence on engine coolant temperature and intake air temperature.

4. An air-fuel ratio control system as claimed in claim 1, wherein said means for controlling the opening of said automatic choke valve controls the opening of said automatic choke valve in dependence on intake air temperature and atmospheric pressure, while said determining means determines that said exhaust gas sensor is inactive.

5. An air-fuel ratio control system as claimed in claim 1, wherein the opening of said air-fuel ratio control valve is held at zero, while said determining means determines that said exhaust gas sensor is inactive.

6. An air-fuel ratio control system as claimed in claim 1, wherein the opening of said air-fuel ratio control valve is held at one of maximum and minimum values thereof and the opening of said automatic choke valve is varied so that the actual value of the air-fuel ratio becomes equal to the desired value thereof when the difference between the desired value of the air-fuel ratio and the actual value thereof is larger than said predetermined value, from the time said determining means determines for the first time that said exhaust gas sensor has become activated to the time said temperature sensing means detects completion of warming-up of said engine.

7. An air-fuel ratio control system as claimed in claim 6, wherein the opening of said automatic choke valve is changed by a predetermined value with respect to an immediately preceding value thereof.

8. An air-fuel ratio control system as claimed in claim 1, wherein the opening of said air-fuel ratio control valve is set to values corresponding to the difference between the desired value of the air-fuel ratio and the actual value thereof and the opening of said automatic choke valve is held at an immediately preceding value thereof when the difference between the desired value of the air-fuel ratio and the actual value thereof is smaller than said predetermined value, from the time said determining means determines for the first time that said exhaust gas sensor has become activated to the time said temperature sensing means detects completion of warming-up of said engine.

9. An air-fuel ratio control system as claimed in claim 1, wherein the opening of said air-fuel ratio control valve is set to values corresponding to the difference between the desired value of the air-fuel ratio and the actual value thereof and the opening of said automatic choke valve is held at a maximum value thereof after said temperature sensing means detects completion of warming-up of said engine.

* * * * *

UNITED STATES PATENT AND TRADEMARK OFFICE

CERTIFICATE OF CORRECTION

PATENT NO. : 4,753,209

DATED : June 28, 1988

INVENTOR(S) : Yoshitaka Hibino et al

It is certified that error appears in the above-identified patent and that said Letters Patent is hereby corrected as shown below:

On the Title Page, Item [75] add:

-- Hiromitsu Sato; Masahiko Asakura --

Item [75] "both" should read -- all --.

Signed and Sealed this

Fifteenth Day of November, 1988

*Attest:*

DONALD J. QUIGG

*Attesting Officer*

*Commissioner of Patents and Trademarks*